US010294548B1

(12) United States Patent
Anderson et al.

(10) Patent No.: US 10,294,548 B1
(45) Date of Patent: May 21, 2019

(54) HARD AND SUPER-HARD METAL ALLOYS AND METHODS FOR MAKING THE SAME

(71) Applicants: Iver E. Anderson, Ames, IA (US); Bruce A. Cook, Ankeny, IA (US); Joel Harringa, Ames, IA (US); Adam Boesenberg, Ankeny, IA (US); Joel Rieken, Carmel, IA (US); Dave Byrd, Boone, IA (US)

(72) Inventors: Iver E. Anderson, Ames, IA (US); Bruce A. Cook, Ankeny, IA (US); Joel Harringa, Ames, IA (US); Adam Boesenberg, Ankeny, IA (US); Joel Rieken, Carmel, IA (US); Dave Byrd, Boone, IA (US)

(73) Assignee: U.S. Department of Energy, Washington, DC (US)

( * ) Notice: Subject to any disclaimer, the term of this patent is extended or adjusted under 35 U.S.C. 154(b) by 439 days.

(21) Appl. No.: 15/004,543

(22) Filed: Jan. 22, 2016

Related U.S. Application Data

(63) Continuation of application No. 13/844,751, filed on Mar. 15, 2013, now abandoned, which is a continuation of application No. 13/066,748, filed on Apr. 22, 2011, now abandoned.

(60) Provisional application No. 61/343,135, filed on Apr. 23, 2010.

(51) Int. Cl.

| | |
|---|---|
| ***B22F 1/00*** | (2006.01) |
| ***B22F 3/14*** | (2006.01) |
| ***B22F 3/16*** | (2006.01) |
| ***B22F 5/00*** | (2006.01) |
| ***B22F 9/04*** | (2006.01) |
| ***C22C 9/01*** | (2006.01) |

(52) U.S. Cl.
CPC ..... *C22C 9/01* (2013.01); *B22F 1/0003* (2013.01); *B22F 3/14* (2013.01); *B22F 3/16* (2013.01); *B22F 5/00* (2013.01); *B22F 9/04* (2013.01)

(58) Field of Classification Search
CPC .. C22C 9/01; B22F 1/0003; B22F 3/14; B22F 3/16; B22F 5/00; B22F 9/04
See application file for complete search history.

(56) References Cited

U.S. PATENT DOCUMENTS

| | | | | |
|---|---|---|---|---|
| 4,398,969 A * | 8/1983 | Melton | C22F 1/006 | 148/402 |
| 4,410,488 A * | 10/1983 | Gessinger | B22F 3/16 | 148/513 |
| 5,114,468 A * | 5/1992 | Akutsu | C22C 1/0425 | 75/234 |
| 2004/0261913 A1* | 12/2004 | Ishida | C22C 9/00 | 148/432 |

FOREIGN PATENT DOCUMENTS

JP 04131337 A * 5/1992

* cited by examiner

*Primary Examiner* — Keith Walker
*Assistant Examiner* — John A Hevey
(74) *Attorney, Agent, or Firm* — Jacob A. Heafner; Michael J. Dobbs; Brian J. Lally

(57) ABSTRACT

The present invention relates to $Cu_{33}Al_{17}$ alloys and $Cu_{33}Al_{17}$-based bulk alloys and coatings that exhibit significantly increased hardness characteristics compared to traditional copper-aluminum alloys.

15 Claims, 2 Drawing Sheets

HARD AND SUPER-HARD METAL ALLOYS AND METHODS FOR MAKING THE SAME

RELATED APPLICATIONS

The present application is a continuation in part of, and claims priority to, U.S. patent application Ser. No. 13/844,751, filed on Mar. 15, 2013 by the same inventors, the entirety of which is hereby incorporated by reference; which is a continuation in part of U.S. patent application Ser. No. 13/066,748, filed on Apr. 22, 2011, the entirety of which is hereby incorporated by reference; which is non-provisional patent application of, and claims priority to, U.S. Provisional Patent Application No. 61/343,135, filed on Apr. 23, 2010.

GOVERNMENT INTERESTS

This invention was made with government support under Contract No. DE-AC02-07CH11358 awarded by the U.S. Department of Energy. The U.S. Government has certain rights in the invention.

FIELD OF INVENTION

The present invention relates to metal alloy composites and coatings, and methods for making the same. More specifically one or more preferred embodiments of the invention related to $Cu_{33}Al_{17}$ alloys and $Cu_{33}Al_{17}$ based alloys and coatings, and methods for making the same.

BACKGROUND OF THE INVENTION

Hard and super-hard materials (having micro-hardness ≥15 GPa and ≥40 GPa respectively) are required for a variety of industrial and uses such as cutting tools, wear-resistance coatings, automobile parts, abrasives, electronics, medical devices, and aerospace applications. Due to their wide range of industrial uses global demand for hard and super-hard materials has grown rapidly over the past decade. In fact, the global super-hard materials market alone is projected to reach over $20 billion by 2018. (See, "Manufacturing Activity in Developing Countries Encourages Use of Superhard Materials in Machine Tools, According to New Report by Global Industry Analysts, Inc.", prweb.com article dated, Oct. 8, 2012.)

In response to rising demand researchers around the world have been searching for new hard and super-hard materials. The recent research in this area has focused on the exploration of compounds formed by boron (B), carbon (C), nitrogen (N), and oxygen (O), that have the potential to form strong three-dimensional covalent bonds capable of producing hard and super-hard materials. ("See, Predicting New Superhard Phases," Journal of Superhard Materials, 2010, Vol. 32, No. 3, pp. 192-204. Allerton Press, Inc., 2010, Original Russian Text, Q. Li, H. Wang, Y. M. Ma, 2010, published in Sverkhtverdye Materialy, 2010, Vol. 32, No. 3, pp. 66-81.) With the focus on B, C, N and O containing materials, conventional metal alloys have been largely ignored as potential hard and super-hard materials due to the fact that metals and their alloys typically exhibit low hardness due to the ease with which dislocations can propagate within their structures and the type of chemical bonding typically found in such materials.

$Cu_{33}Al_{17}$ and related $Cu_{33}Al_{17}$-based alloys and composites are potentially remarkable exceptions to this rule as initial results indicate that $Cu_{33}Al_{17}$ exhibits a nanoindentation hardness of 31.4±5.8 GPa when supported on a Sn matrix, and 49.1±2.5 GPa when supported by $Ag_3Sn$ blades ("Development of Sn—Ag—Cu—X Solders for Electronic Assembly by Micro-Alloying with Aluminum," Journal of Electronic Materials, July 2012, Volume 41, Issue 7, pp 1868-188, Adam J. Boesenberg et al.; see also, U.S. patent application Ser. No. 13/066,748.)

These hardness values are a surprising and unexpected discovery since no alloy or compound comprised solely of conventional metals has ever been reported to possess such hardness. This initial data suggests that the hardness of $Cu_{33}Al_{17}$ (and certain related $Cu_{33}Al_{17}$ alloys and composites) may be in the range of about 31-49 GPa, which is higher than both SiC, $Al_2O_3$ and on the order of $TiB_2$. These hardness values are astounding considering the low hardness characteristics of the alloy's constituent elements (i.e. Cu and Al). As a point of reference, the Vicker's hardness of Cu is about 0.4 GPa while that of Al is on the order of 0.2 GPa. So clearly, an alloy comprised solely of Al and Cu would not be expected to have a hardness that is an order of magnitude or even several orders of magnitude greater than its component elements. As such, this discovery represents a potentially revolutionary new class of hard and super-hard metal-based materials that has a number of industrial applications and may prove to be the long sought copper based stainless steel without Fe, Cr or Ni.

It is notable that $Cu_{33}Al_{17}$ alloys (and methods for producing such) are largely absent from available scientific literature. The absence of $Cu_{33}Al_{17}$ from literature is likely due to several factors including the fact that $Cu_{33}Al_{17}$ is peritectoid compound which is not capable of being produced using conventional solidification techniques (i.e. will not produce a homogenous, uniform composition with the intended stoichiometry). Similarly, the inventors discovered that long term annealing also fails to produce the desired phase since the diffusion kinetics are sluggish. The difficulties associated with creating $Cu_{33}Al_{17}$ in bulk form initially led the inventors to believe that solid-state mechanical alloying of either Cu and Al powders or Cu—Al alloy powders would be the only way to create single-phase, homogenous $Cu_{33}Al_{17}$. Surprisingly, the inventors discovered a new method for creating such materials that does not require the complexity and expense of mechanical alloying.

Prior to the current discovery, the only known reference to $Cu_{33}Al_{17}$ was its identification as a potential phase within of a larger Cu—Al peritect diagram (See, Murray J. L., Al—Cu (Aluminum-Copper), Binary Alloy Phase Diagrams, II Ed., Ed. T. B. Massalski, Vol. 1, 1990, p. 141-143.) Although more recent Cu—Al phase diagram references have been reported, the Murray reference serves well to indicate the temperatures and composition of this $Cu_{33}Al_{17}$ phase. While Murray identifies $Cu_{33}Al_{17}$ as potential phase, it is important to note that there is no known prior reporting of a homogenous and uniform $Cu_{33}Al_{17}$ alloy in bulk form or a method of making the same.

These and other objects, aspects, and advantages of the present disclosure will become better understood with reference to the accompanying description and claims.

SUMMARY OF PREFERRED EMBODIMENTS OF THE INVENTION

One or more preferred embodiments of the present invention relate to novel single-phase copper-aluminum bulk alloys (i.e. $Cu_{33}Al_{17}$) having significantly increased hardness characteristics and methods of making the same.

Other preferred embodiments of the present invention relate to novel copper-aluminum based bulk alloys (i.e.

$Cu_{33}Al_{17}$ based alloys) having significantly increased hardness characteristics and methods of making such.

Another embodiment of the present invention relates to novel copper-aluminum based coatings (i.e. $Cu_{33}Al_{17}$ and $Cu_{33}Al_{17}$ based coatings) having significantly increased hardness characteristics and methods of making the same.

Yet another preferred embodiment of the present invention relates to copper-aluminum based composites (i.e. $Cu_{33}Al_{17}$ and $Cu_{33}Al_{17}$ based) and composite coatings having significantly increased hardness characteristics and methods of making such.

DETAILED DESCRIPTION OF THE PREFERRED EMBODIMENTS OF THE INVENTION

One or more embodiments of the invention relate to a new class of copper-aluminum alloys (and related composites and coatings) with surprising hardness, and methods for producing the same. This new class of copper-aluminum alloys has the potential for a wide-range of applications including but not limited to: non-sparking tools (replacing Cu—Be tools that have toxicity hazards), marine fasteners (with anti-fouling properties), cutting blades (with high temperature oxidation resistance) that display anti-bacterial properties and a variety of other applications.

Method for Producing $Cu_{33}Al_{17}$-Based Alloys

One preferred embodiment of the present invention is directed to a method for producing $Cu_{33}Al_{17}$ based alloys in bulk form generally comprising:

a. mixing Cu and Al powders to form a blended Cu—Al-based powder mixture;
b. cold pressing the blended copper-aluminum based powder mixture to form a copper-aluminum green body; and
c. sintering the copper-aluminum green body forming a uniform single-phase $Cu_{33}Al_{17}$ bulk alloy.

Forming a Blended Cu—Al Based Powder Mixture

In the initial step, defined amounts of high purity Cu and Al powders (as well as additives including those described below) are mixed to form a copper-aluminum based powder mixture. The Cu and Al powders should be blended for sufficient time to form a homogeneous and uniform powder mixture, preferably without segregation of any of the component elements.

Cu powder should generally be added an amount between about 77-80 weight (hereafter abbreviated as wt.) % of the blended Cu—Al-based powder mixture, preferably between about 77.4-79.2 wt. %, more preferably between about 77.43-79.28 wt. %, even more preferably between about 78.4-79.3 wt. %.

Al powder is generally present at between 20-23 wt. % of the blended copper-aluminum based powder mixture, preferably between about 20-23 wt. %, more preferably between about 20.7-22.6 wt. %, even more preferably between 20.72-22.57 wt. %, even more preferably between about 20.72-21.56. The proper amount of Al is critical to ensuring the formation of a uniform, single-phase bulk alloy.

A salient aspect of the invented alloy is the ratio between Cu and Al as indicated by the their atomic percent in the alloy, ignoring additive elements such as Sn, Zn, and Ge. Atomic percent (at. %) is calculated as 100 times the mole fraction of a component i, where the mole fraction is denoted as $x_i$, refers to the number of mol ($n_i$) of i in the solution divided by the total number of mol ($n_{tot}$) in the solution (again, ignoring all but Cu and Al). Cu and Al is generally present in a range of 59.2-62 at. % Cu and 40.8-38.0 at. % Al, but preferably between about 60-61.75 at. % Cu and 40-38.25 at. % Al, and more preferably between about 61-61.5 at. % Cu and 39-38.5 at. % Al.

Figure 1:
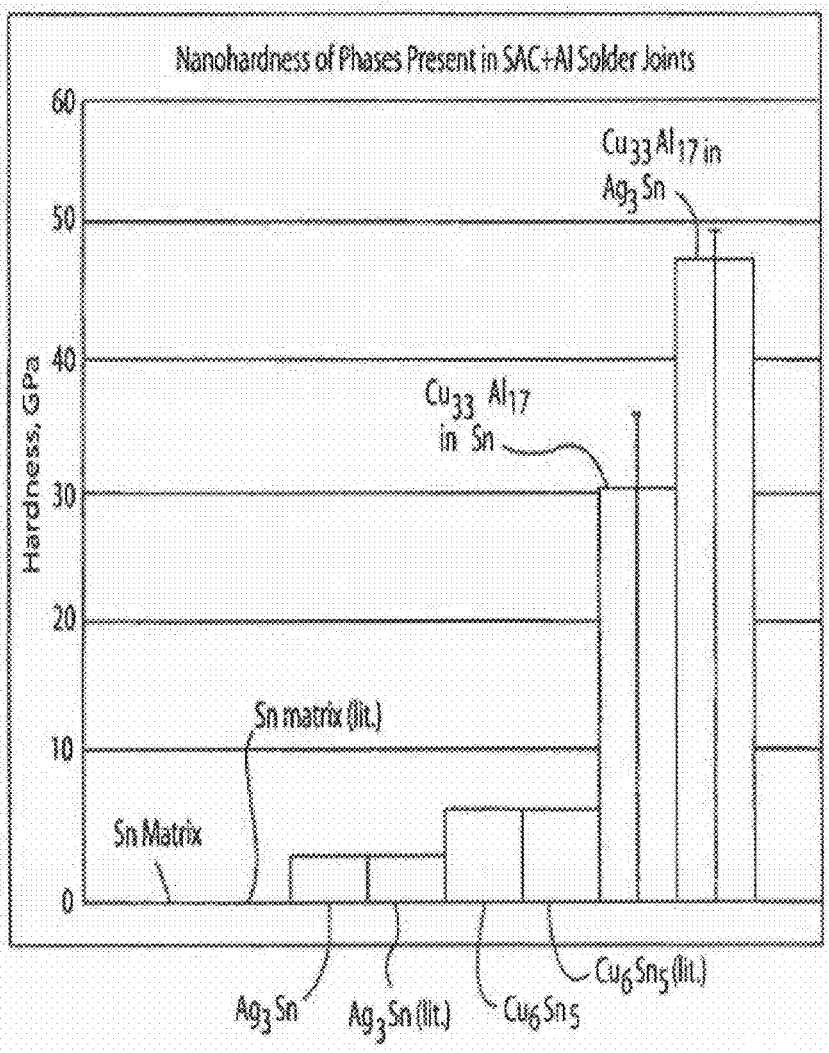
FIG. 1 is a bar graph illustrating nanohardness measurements showing the hardness of $Cu_{33}Al_{17}$ phases and other solder joint solidification product phases taken in tin and in $Ag_3Sn$ blade phase regions. Sn matrix (lit.) and $Ag_3Sn$ (lit.) are published literature values.
Figure 2:
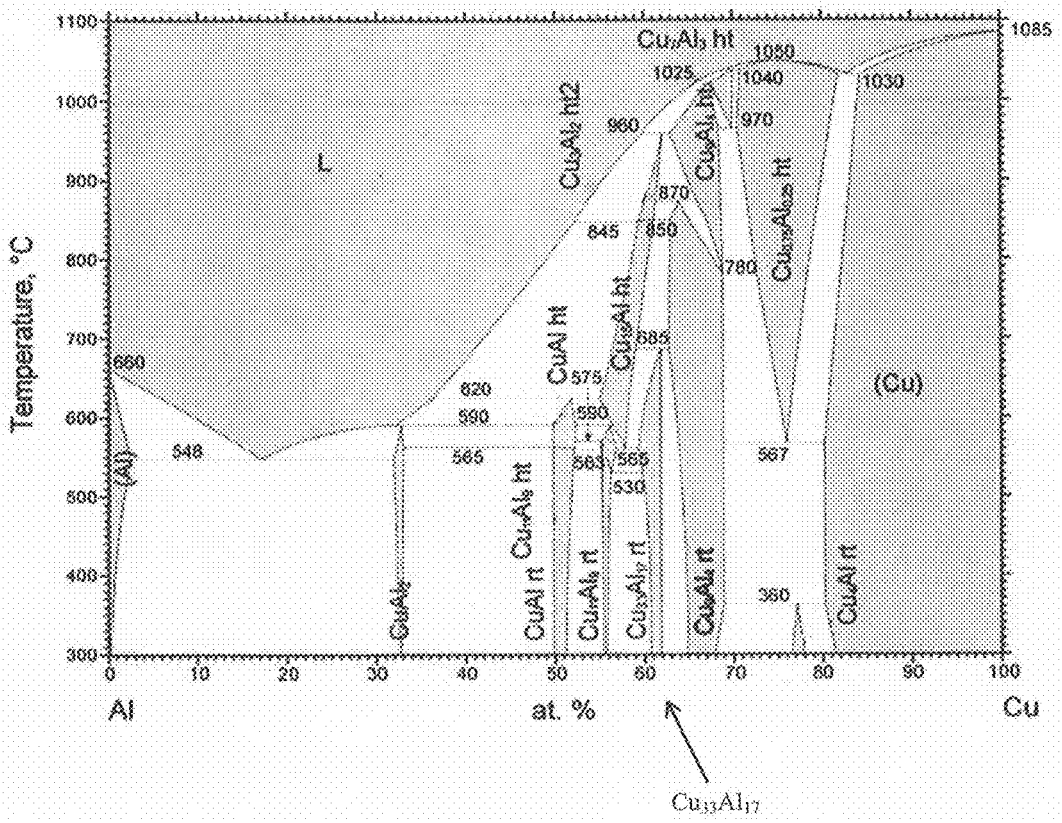
FIG. 2 is illustrates a Cu—Al phase diagram.

The proper at. % of Cu to Al is critical to ensuring the formation of a uniform, single-phase bulk alloy. As illustrated in phase diagram shown in FIG. 2, the $Cu_{33}Al_{17}$ phase is not centered on the actual chemical stoichiometry equivalents. Referring still to FIG. 1, of note is the stoichiometric formulation of $Cu_{33}Al_{17}$ (66 at. % Cu-34 at. % Al) lies in the middle of the $Cu_9Al_4$ phase field. Thus, the unexpected non-stoichiometric 59.2-62 at. % Cu and 40.8-38.0 at. % Al blend is critical in achieving the desired $Cu_{33}Al_{17}$ single phase bulk alloy.

The proper amount of Cu is critical to ensuring the formation of a uniform, single-phase bulk alloy. Adding Cu in amounts exceeding the preferred at % ranges will produce either a mixed-phase composite consisting of two or more chemically distinct Cu—Al phases, or a different and unintended single phase depending on the extent to which the desired stoichiometry is exceeded. Likewise, adding Cu in amount less than the preferred ranges results in one or more chemically distinct Cu—Al phases, possibly containing none of the desired $Cu_{33}Al_{17}$ depending on the extent to which the actual stoichiometry deviates from the desired at % stoichiometry.

A number of blending methods, times and devices can be employed to mix the powders as long they produce a homogenous and uniform powder mixture. It may be preferable to employ a specialized powder mixing device such as a TURBULA oscillating blender manufactured by Glen Mills Inc. (Clifton, N.J.). One suitable method is blending the powder mixture for about 20 minutes in an oscillating powder blender.

Another important aspect of the invention is the purity of the metal elements being blended. The aluminum and copper powders (as well as any other alloying elements that are added) are preferably at commercial purity levels (i.e. 99% pure) or higher. At lower purity levels, especially with Al and/or Cu powder that has more heavily oxidized surfaces, a mechanical milling step may preferable to employ.

One preferred method of producing metals powders of such purity is through high pressure $N_2$ gas atomization available from Ames Laboratory, Ames, Iowa Other methods can be employed as long as they produced the desire purity levels.

Regarding particle size in the powders, small particles, while facilitating interparticle diffusion, are also more prone to parasitic chemical impurities, especially oxide surface coatings, because of their high surface to volume ratio. Larger particles possess a higher volume of chemically pure material, but exacerbate diffusion due to the increased distances required for chemical homogenization. A preferred size range to avoid either extreme is about 1 to 10 microns on the low end and about 100 microns on the higher end.

This invention also envisions $Cu_{33}Al_{17}$ based alloys (and method of making such) that can be produced by adding small amounts of additional elements (in similar powdered form) during the initial mixing phase. It is believed that the addition of certain elements may improve various characteristics of the resultant alloy including the potential to provide further increases in hardness. Preferable additives include but are not limited to: Zn, Sn, Ge and combinations thereof, Sn being the most preferred. These additives should generally be added in an amount equal to or less than about 2 wt. % of the copper-aluminum based powder mixture.

The present invention also envisions composites containing $Cu_{33}Al_{17}$ (or $Cu_{33}Al_{17}$-based alloys) and one or more hard compounds such as carbides, borides, and/or nitrides to form a bulk composites (with either 33-17 phase or the other compound as the reinforcement phase), that could display synergistic effects in terms of bulk and/or shear modulus on the more ductile matrix phase, leading to a significant increase in strength and hardness beyond that of either single phase composition. One embodiment of the such a composite comprises and/or consists and/or consists essentially of: $Cu_{33}Al_{17}$+X, where X=includes but is not limited to one or more of the following: $AlMg_{14}$, $TiB_2$, SiC, $Al_2O_3$, WC, TiC, TaC, cubic BN $B_4C$ and combinations thereof. These bulk nanocomposites could be prepared by mechanical milling and hot pressing or by a simple pressing and sintering process. Alternatively, the powders can be milled or cryo-milled in addition to or in place of the initial mixing step.

Forming of a Cu—Al Based Green Body

Once blended the copper-aluminum based powder mixture is cold pressed to form a pressed Cu—Al green body with relatively high density (typically between about 85-90% of theoretical density. Preferably, the powder mixture is cold pressed using a cold isostatic press (CIP) at pressures and times sufficient to reach the required density. Exemplary pressures are between about 40,000 and 60,500 psi.

Forming a Uniform, Single-Phase $Cu_{33}Al_{17}$ Bulk Alloy

In a preferred embodiment, the green body is sintered to facilitate diffusion between the individual particles and achieve a homogeneous, uniform composition. The sintering temperature should be sufficiently high so as to maximize the diffusion rate (which, according to classical theory is related to temperature by an Arrhenius equation of the form $D=Do*\exp\{-Q/kT\}$, where D is the diffusion coefficient, Do is a constant, Q is the activation energy, k is Boltzman's constant, and T is the absolute temperature); however, the temperature must remain below the limit of the phase boundary to avoid nucleation of additional phases.

In the case of the $Cu_{33}Al_{17}$ phase, the binary phase diagram from Murray (Murray J. L., Al—Cu (Aluminum-Copper), Binary Alloy Phase Diagrams, II Ed., Ed. T. B. Massalski, Vol. 1, 1990, p. 141-143) shows that this phase is stable to a maximum temperature of 685° C., above which it decomposes by peritectoid reaction into a mixture of $Cu_{15}Al$ and $Cu_9Al_4$.

A sintering temperature of about 500-650° C. is preferable to ensure that the process occurs within the equilibrium phase stability boundary, while allowing for an enhanced diffusion rate and avoiding phase decomposition (into $Cu_{15}Al+Cu_9Al_4$) due to overheating resulting from possible errors in thermocouple (temperature) measurement or in furnace temperature control. It is also preferable to stay below 660° C. to avoid melting of the pure Al powder which would promote formation of a Al2Cu intermetallic compound that may reduce the rate of the preferred solid state reaction route to form $Cu_{33}Al_{17}$. A preferred sintering temperature is about 625° C.

Preferably, the green body is sintered in a (diffusion pumped) vacuum furnace and sintered at a vacuum level (one suitable range between $10^{-5}$ to $10^{-6}$ torr) to achieve the desired bulk single-phase compound.

Alternate embodiments of the present invention envision additional processing steps including but not limited to pressure driven consolidation after sintering to achieve full densification of the bulk alloy. This additional step may significantly improve certain characteristics of the resultant bulk alloy including increased hardness.

In another alternate embodiment the sintering step is replaced by pressure driven consolidation, preferably using a hot press. The pressure drive consolidation phase is preferably done at similar temperature ranges as the sintering step described above and pressures between about 5,000-20,000 psi are suitable, realizing greater pressures could be employed.

This invention also envisions products made according to the methods and other details described herein.

$Cu_{33}Al_{17}$ and $Cu_{33}Al_{17}$ Based Coatings

The present invention also envisions the use of various thin film deposition methods to create $Cu_{33}Al_{17}$ and $Cu_{33}Al_{17}$-based coatings. One or more preferred methods would employ a type of physical vapor deposition (PVD), more preferably pulsed laser deposition (PLD) using bulk $Cu_{33}Al_{17}$, a bulk $Cu_{33}Al_{17}$-based alloy, or a bulk $Cu_{33}Al_{17}$ composite as a sputtering target. One of the keys to producing such films is ensuring a sufficiently fine structure in the sputtering target that minimizes diffusion distances between the Cu and Al particles and/or ensuring that the target is completely uniform in composition. Limiting the diffusion distances and/or ensuring complete uniformity of the bulk alloy may be produced by vacuum hot pressing to achieve full density of the composition without the need for mechanical alloying of the blended Cu and Al powder. This method would facilitate formation of the desired single-phase compound at deposition substrate temperatures below the compound's peritectoid decomposition temperature as an oxidation and wear resistant coating on any desired metallic surface, e.g., cutting tools, cutting blades, or solar thermal energy collecting mirrors etc. See generally, Pulsed Laser Deposition of Thin Films, edited by Douglas B. Chrisey and Graham K. Hubler, John Wiley & Sons, 1994 ISBN 0-471-59218-8.

$Cu_{33}Al_{17}$ and $Cu_{33}Al_{17}$ Based Bulk Alloys

One or more embodiments of the present invention relate to $Cu_{33}Al_{17}$ and $Cu_{33}Al_{17}$ based bulk alloys.

Cu should generally be present an amount between about 77-82 weight wt. % of the alloy, preferably between about 77.4-79.2 wt. %, more preferably between about 77.43-79.28 wt. %, even more preferably between about 78.4-79.3 wt. %.

Al is generally present in an amount between about 18-23 wt. % of the alloy, preferably between about 20-23 wt. %, more preferably between about 20.7-22.6 wt. %, even more preferably between 20.72-22.57 wt. %, even more preferably between about 20.72-21.56 wt. %.

Additives such as Sn, Zn, and Ge can be present at up about 2 wt. % of the alloy.

In one preferred embodiment of the present invention, the bulk $Cu_{33}Al_{17}$-based alloy consists essentially of: about 77.4-79.2 wt. % Cu and about 20.7-22.6 wt. % Al, with the remainder consisting of unavoidable impurities.

In yet another preferred embodiment of the present invention, the bulk $Cu_{33}Al_{17}$-based alloy consists of: about 77.43-79.28 wt. % Cu and about 20.72-22.57 wt. % Al, with the remainder consisting of unavoidable impurities.

In yet another preferred embodiment of the present invention, the bulk $Cu_{33}Al_{17}$-based alloy comprises about 78.4-

79.3 wt. % Cu and about 20.72-21.56 wt. % Al, with the remainder consisting of unavoidable impurities.

In another preferred embodiment of the present invention, the bulk $Cu_{33}Al_{17}$-based alloy consists essentially of: about 77.4-79.2 wt. % Cu and about 20.7-22.6 wt. % Al, with remainder consisting of one or more elements selected from the group consisting of: Zn, Sn, Ge and combinations thereof.

In yet another preferred embodiment of the present invention, the bulk $Cu_{33}Al_{17}$-based alloy consists of: about 77.43-79.28 wt. % Cu and about 20.72-22.57 wt. % Al, with remainder consisting of one or more elements selected from the group consisting of: Zn, Sn, Ge and combinations thereof.

In yet another preferred embodiment of the present invention, the bulk $Cu_{33}Al_{17}$-based alloy comprises of: about 78.4-79.3 wt. % Cu and about 20.72-21.56 wt. % Al, remainder consisting of one or more elements selected from the group consisting of: Zn, Sn, Ge and combinations thereof.

Hardness

It is believed that the copper-aluminum alloys (and possibly the related composites and coatings) of the present invention or made using the methods described herein have will exhibit a microhardness of at least 5 GPa, and that with the additional and/or alternative processing such using pressure drive consolidation in addition to or in place of the sintering step and/or the addition of small amounts of additional elements (preferably as described herein) could produce copper-aluminum alloys and copper-aluminum-based alloys (and related coatings) that exhibit are hardness of at least 10 GPa, even 15 GPa, even 20 GPa, even 25 GPa, even 30 GPa, even 35 GPa, even 40 GPa and even 50 GPa or more.

Likewise it is believed that the copper-aluminum based and/or copper-aluminum containing composites of the present invention including those made using the methods described herein have will exhibit microhardness similar to that described above. One method for measuring hardness of a material is ASTM E10-12.

Example I: 77.8 wt. % Cu 21.2 wt. % Al

Example II: 78.4 wt. % Cu 20.9 wt. % Al 0.5 wt. % Sn

Example III: 79.3 wt. % Cu 20.7 wt. % Al

Example IV: 78 wt. % Cu 21 wt. % Al 1 wt. % Zn

Results

A bulk $Cu_{33}Al_{17}$-base alloy was recently produced by the inventors as described below. The Al and Cu powders were high pressure ($N_2$) gas atomized at Ames Lab from 99.99% pure Al and Cu. The basic process that was practiced was to weigh out quantities of the two constituent powders: 78.8 wt. % Cu+21.2 wt. % Al (61.2 at. % Cu+38.8 wt. % Al), to place the powders in a glass container, to insert the container into a mixing device (a TURBULA blender), and to use the blender to oscillate the container for about 20 minutes in such a way as to thoroughly mix the two powders. The objective was to achieve a homogeneous, uniform mixture of the two, without segregation of either Cu or Al.

Once blended the copper-aluminum based powder mixture is cold pressed to form a pressed Cu—Al green body with relatively high density (typically between about 85-90% of theoretical density. Preferably, the powder mixture is cold pressed using a cold isostatic press (CIP) at pressures and times sufficient to reach the required density. Exemplary pressures are between about 40,000 and 60,500 psi.

The green body was placed in a (diffusion pumped) vacuum furnace and sintered at a vacuum level of $10^{-5}$ to $10^{-6}$ torr to achieve the desired bulk single-phase compound. (Time and temperature 625° C. for 12 hours).

The crystal structure of the as-sintered form of the $Cu_{33}Al_{17}$ phase was verified by X-ray diffraction analysis and the microhardness was measured to be 680 kg/mm2 or approximately 6.8 GPa.

While the measured hardness of the bulk alloy was less is originally measure in the initial testing of the 33-17 phase measured in the previous solder phase, 6.8 GPA is still surprising and unexpected given that such a value is an order of magnitude greater than the hardness of the component elements (0.4 and 0.2 GPa respectively). Even at about 5 GPa or above, the hardness values are unexpected and produce materials that have a variety of value.

It is believed that the lower than expected hardness measurement of the as-sintered bulk sample is that a significant amount (not measured, but probably at least about 1-2%) of finely dispersed porosity was present in the as-sintered sample. This amount of porosity could lead to a significantly lower measured hardness on the surface if some yielding of the porous structure immediately under the hardness indent provided additional compliance and a greater than expected depth to the indenter impression. This is why we have proposed the alternate or additional step of achieving full densification by pressure-driven consolidation.

Having described the basic concept of the invention, it will be apparent to those skilled in the art that the foregoing detailed disclosure is intended to be presented by way of example only, and is not limiting. Various alterations, improvements, and modifications are intended to be suggested and are within the scope and spirit of the present invention. Additionally, the recited order of the elements or sequences, or the use of numbers, letters or other designations therefore, is not intended to limit the claimed processes to any order except as may be specified in the claims. All ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like refer to ranges which can be subsequently broken down into sub-ranges as discussed above. Accordingly, the invention is limited only by the following claims and equivalents thereto.

All publications and patent documents cited in this application are incorporated by reference in their entirety for all purposes to the same extent as if each individual publication or patent document were so individually denoted.

We claim:

1. A method for producing $Cu_{33}Al_{17}$ based peritectoid alloys in bulk form comprising:

mixing Cu powder and Al powder in sufficient amounts to form a blended copper-aluminum based mixture consisting essentially of: 59.2-62 at. % Cu and 40.8-38 at. % Al with the remainder consisting of one or more elements selected from the group consisting of: Zn, Sn, Ga, Ge and combinations thereof, or unavoidable impurities;

cold pressing the blended copper-aluminum based mixture to form a copper-aluminum green body; and sintering the pressed copper aluminum to form a uniform, single-phase $Cu_{33}Al_{17}$ peritectoid alloy.

2. The method of claim 1, wherein the sintering step is followed by pressure driven consolidation.

3. A method for producing $Cu_{33}Al_{17}$ based peritectoid alloys in bulk form comprising:

mixing Cu powder and Al powder in sufficient amounts to form a blended copper-aluminum based mixture consisting essentially of: 59.2-62 at. % Cu and 40.8-38 at. % Al with the remainder consisting of one or more elements selected from the group consisting of: Zn, Sn, Ga, Ge and combinations thereof, or unavoidable impurities;

cold pressing the blended copper-aluminum based mixture to form a copper-aluminum green body; and hot pressing the pressed copper aluminum to form a uniform, single-phase $Cu_{33}Al_{17}$ alloy.

4. The method of claim 1, wherein the copper-aluminum based mixture consists of: 77-80 wt. % Cu and 20-23 wt. % Al.

5. The method of claim 1, wherein the copper-aluminum based mixture consists essentially: 77.4-79.2 wt. % Cu and 20.7-22.6 wt. % Al.

6. The method of claim 1 wherein the copper-aluminum based mixture consists of: 77.4-79.2 wt. % Cu and 20.7-22.6 wt. % Al.

7. The method of claim 1, wherein the copper-aluminum based mixture consists essentially: 77.43-79.28 wt. % Cu and 20.72-22.57 wt. % Al.

8. The method of claim 1, wherein the copper-aluminum based mixture consists of: 77.43-79.28 wt. % Cu and 20.72-22.57 wt. % Al.

9. The method of claim 1, wherein the copper-aluminum based mixture consists essentially: 78.4-79.3 wt. % Cu and 20.72-21.56 wt. % Al.

10. The method of claim 1, wherein the copper-aluminum based mixture consists of: 78.4-79.3 wt. % Cu and 20.72-21.56 wt. % Al.

11. The method of claim 1, wherein Cu and Al are mixed in an at. % ratio of between about 60-61.75 at. % Cu and 40-38.25 at. % Al.

12. The method of claim 1, wherein Cu and Al are mixed in an at % ratio of between about 61-61.5 at. % Cu and 39-38.5 at. % Al.

13. The method of claim 1, wherein mixture consists essentially of: 77.4-79.2 wt. % Cu and 20.72-22.57 wt. % Al with the remainder consisting of one or more elements selected from the group consisting of: Zn, Sn, Ga, Ge, and combinations thereof.

14. The method of claim 1, wherein mixture consists essentially of: 77.4-79.2 wt. % Cu and 20.72-22.57 wt. % Al with the remainder consisting: Sn, wherein Cu and Al are mixed in an at. % ratio of between about 59.2-62 at. % Cu and 40.8-38.0 at. % Al.

15. The method of claim 1, wherein the copper-aluminum green body is sintered at a temperature of between about 500-650° C.

* * * * *